US010714840B1

(12) United States Patent
West et al.

(10) Patent No.: US 10,714,840 B1
(45) Date of Patent: Jul. 14, 2020

(54) WAVELENGTH SCALED APERTURE (WSA) ANTENNA ARRAYS

(71) Applicant: Rockwell Collins, Inc., Cedar Rapids, IA (US)

(72) Inventors: James B. West, Cedar Rapids, IA (US); Matilda Gabriela Livadaru, Marion, IA (US); Jeremiah Damien Wolf, Atkins, IA (US); Theodore Jay Hoffmann, Palo, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 61 days.

(21) Appl. No.: 15/825,711

(22) Filed: Nov. 29, 2017

(51) Int. Cl.
*H01Q 21/30* (2006.01)
*H01Q 21/00* (2006.01)

(52) U.S. Cl.
CPC ..... *H01Q 21/30* (2013.01); *H01Q 21/0087* (2013.01)

(58) Field of Classification Search
CPC .. H01Q 5/25; H01Q 5/28; H01Q 5/40; H01Q 5/42; H01Q 21/0087; H01Q 21/061; H01Q 21/065; H01Q 21/22; H01Q 21/30
See application file for complete search history.

(56) References Cited

U.S. PATENT DOCUMENTS 5,838,282 A * 11/1998 Lalezari ..... H01Q 21/26 343/727
8,405,564 B2 * 3/2013 Kindt ..... H01Q 13/08 343/770
2013/0163705 A1 * 6/2013 Stirland ..... H01Q 3/26 375/346

OTHER PUBLICATIONS

Cantrell et al., "Wideband Array Antenna Concept", 2005 IEEE. 5 pages.

* cited by examiner

*Primary Examiner* — Daniel Munoz
*Assistant Examiner* — Patrick R Holecek
(74) *Attorney, Agent, or Firm* — Suiter Swantz pc llo

(57) ABSTRACT

An antenna array system can including a plurality of antenna subarray panels assembled together to form a single wavelength scaled aperture (WSA) antenna array. Each antenna subarray panel can include a corresponding plurality of antenna elements such that at least two antenna elements of the plurality of antenna subarray panels have different antenna element sizes. The antenna array system can include one or more beamformer circuits. Each of the one or more beam former circuits can be communicatively coupled to at least one of the plurality of antenna subarray panels. For each adjacent pair of the plurality of antenna subarray panels, each antenna element adjacent to a gap separating the adjacent pair of antenna subarray panels along an elongated boundary of the gap is greater than a predetermined value. The predetermined value can be determined based on a predefined width of the gap separating the pair of adjacent antenna subarray panels.

20 Claims, 10 Drawing Sheets

WAVELENGTH SCALED APERTURE (WSA) ANTENNA ARRAYS

BACKGROUND

In many applications of antenna arrays (or array antennas), whether communication systems, satellite communications (SatCom) systems, military radar systems, electronic intelligence (ELINT) systems, electronic counter measure (ECM) systems, electronic support measure (ESM) systems, aerospace systems, or biological or medical microwave imaging systems, there is a demand for large ultra-wideband (UWB), or even large ultra-ultra-wideband ($U^2WB$), antenna arrays. UWB and ($U^2WB$) antenna arrays operate at (or support) relatively large frequency bands. For example, $U^2WB$ antenna arrays can operate at frequency bands extending from 200 MHz to 60 GHz. In order for antenna arrays to support relatively high frequencies, the respective antenna elements (or radiating elements) are made smaller in size. In particular, the higher the maximum frequency supported by an antenna array, the smaller are the antenna elements of that array.

Also, increasing the size of an antenna array allows for accommodating a larger number of antenna elements and therefore improved antenna array performance. For example, increasing the size of an electronically-scanned array (ESA) antenna or an active ESA (AESA) antenna allows for accommodating a larger number of antenna elements, which can lead to increased signal gain and improved reception sensitivity, and smaller beam width. First, as the number of antenna elements increases, so does the cumulative signal power generated by the antenna elements. Second, in an ESA or AESA antenna system, for example, the increased number of steerable antenna elements can allow for distinguishing between a larger number of signals' phase shifts or time delays, and therefore better spatial discrimination between physical targets.

ESA or AESA antennas are typically built on monolithic printed circuit boards (PCBs). Manufacturing relatively large monolithic PCBs to accommodate large UWB (or $U^2WB$) antenna arrays is technically challenging and has a poor yield. Wavelength scaled aperture (WSA) antenna arrays can allow for supporting UWBs or $U^2WBs$ with relatively smaller number of antenna elements compared to, for example, non-wavelength-scaled antenna arrays. However, even when using WSA configurations, antenna arrays are still desired to have a large number of antenna elements to achieve increased signal gain and improved reception sensitivity.

SUMMARY

In one aspect, embodiments of the inventive concepts disclosed herein are directed to an antenna array system including antenna subarrays tiled together to form a single wavelength scaled aperture (WSA) antenna array. Each antenna subarray can include corresponding antenna elements that are sized to support a corresponding frequency subband of multiple frequency subbands supported by the WSA antenna array. At least two antenna elements of the antenna subarrays can be sized differently. In a further aspect, the antenna array system can include one or more beamformer circuits. Each beam former circuit can be communicatively coupled to at least one of the antenna subarrays. For each pair of adjacent antenna subarrays, each antenna element, of one of the pair of adjacent antenna subarrays, adjacent to a gap separating the pair of adjacent subarrays can be sized to be greater than or equal to a predetermined value. The predetermined value can be determined based on a predefined width of the gap separating the pair of adjacent antenna subarrays.

In a further aspect, the antenna subarrays can include a group of antenna subarrays with corresponding antenna elements having a respective size and supporting a respective frequency subband. The antenna subarrays can include another group of antenna subarrays with corresponding antenna elements having a different size and supporting a different frequency subband.

In a further aspect, the antenna subarrays of each of the groups can be arranged according to corresponding concentric regions of the WSA array.

In a further aspect, the antenna subarrays of one of the groups can be arranged according to one or more corresponding concentric ring regions, and each subarray of that group can occupy an angular sector of one of the one or more concentric ring regions.

In a further aspect, one of the sizes can be greater than or equal to the predetermined value, and a subarray of one of the groups of antenna subarrays can be arranged adjacent to another subarray of the other group of antenna subarrays In a further aspect, the antenna subarrays can further include another group of antenna subarrays with corresponding antenna elements having a size different from the other sizes, and supporting a frequency subband different from the other frequency subbands.

In a further aspect, the one or more beamformer circuits can include, for each antenna subarray, corresponding partial analog beamformer circuits. The one or more beamformer circuits can include one or more hybrid digital beamformer circuits. Each hybrid digital beamformer circuit can have radio frequency channels that are configured to be simultaneously tuned to a single center frequency.

In a further aspect, the antenna array system can include a single hybrid digital beamformer circuit and a radio frequency (RF) switch. The radio frequency (RF) switch can be communicatively coupled to the partial analog beamformer circuits associated with the antenna subarrays and to the single hybrid digital beamformer circuit. The RF switch can be configured to alternately connect the single hybrid digital beamformer circuit to separate groups of the partial analog beamformer circuits associated with the antenna subarrays.

In a further aspect, the antenna array system can include a separate hybrid digital beamformer circuit for each group of antenna subarrays associated with a corresponding frequency subband. the separate hybrid digital beamformer circuit can be connected to partial analog beamformer circuits associated with that group of antenna subarrays.

In a further aspect, the one or more beamformer circuits can include one or more direct digital beam former circuits. Each direct digital beam former circuit can have channels capable of operating simultaneously at distinct center frequencies.

In a further aspect, the antenna array system can include an antenna subarray having antenna elements of at least two different sizes. For the antenna subarray, corresponding antenna elements having a larger size than other antenna elements in that antenna subarray can be arranged adjacent to at least one outer boundary of the antenna subarray.

In a further aspect, the predefined width of the gap can represent a minimum gap width that is implementable.

In a further aspect, the predetermined value is determined based on the minimum width of the gap separating the pair of adjacent antenna elements and a specified performance criterion of the WSA antenna array.

In a further aspect, one of the antenna subarrays can be arranged to form a curved surface.

In one aspect, embodiments of the inventive concepts disclosed herein are directed to a method of assembling a wavelength scaled aperture (WSA) antenna array system. The method can include determining an antenna element size using a specified performance criterion of a WSA antenna array and a predefined inter-subarray gap width. In a further aspect, the method can include identifying, among multiple antenna subarray panels, one or more antenna subarray panels each including antenna elements at a boundary of that antenna subarray panel with a corresponding size greater than or equal to the determined antenna element size. Each antenna subarray panel of the antenna subarray panels can include corresponding antenna elements that support a corresponding frequency subband of multiple frequency subbands supported by the WSA antenna array. At least two of the antenna subarray panels can be associated with different antenna element sizes. In a further aspect, the method can include assembling the antenna subarray panels to form the WSA antenna array, such that each pair of adjacent antenna subarray panels can include at least one of the identified one or more antenna subarray panels.

In a further aspect, the method can include manufacturing the plurality of antenna subarray panels.

In a further aspect, assembling the plurality of antenna subarray panels can include setting, for each pair of adjacent subarray panels, a corresponding inter-subarray gap width between the predefined inter-subarray gap width and a tolerable gap width.

In a further aspect, the method can include determining the tolerable gap width using a size of antenna elements of one of the pair of adjacent subarray panels arranged adjacent to the gap.

In one aspect, embodiments of the inventive concepts disclosed herein are directed to an antenna array system including a plurality of antenna subarray panels assembled to form a single wavelength scaled aperture (WSA) antenna array. Each antenna subarray panel can include corresponding antenna elements sized to support a corresponding frequency subband of multiple frequency subbands supported by the WSA antenna array. At least two of the antenna subarray panels can be associated with different antenna element sizes. In a further aspect, the antenna array system can include one or more beamformer circuits. Each of the one or more beam former circuits can be communicatively coupled to an antenna subarray. For each adjacent pair of the antenna subarrays, each antenna element, of at least one of the adjacent pair of antenna elements, adjacent to a gap separating the adjacent pair of antenna subarrays can be greater than a predetermined value. The predetermined value can be determined based on a predefined width of the gap separating the adjacent pair of antenna subarrays.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

Figure 1:
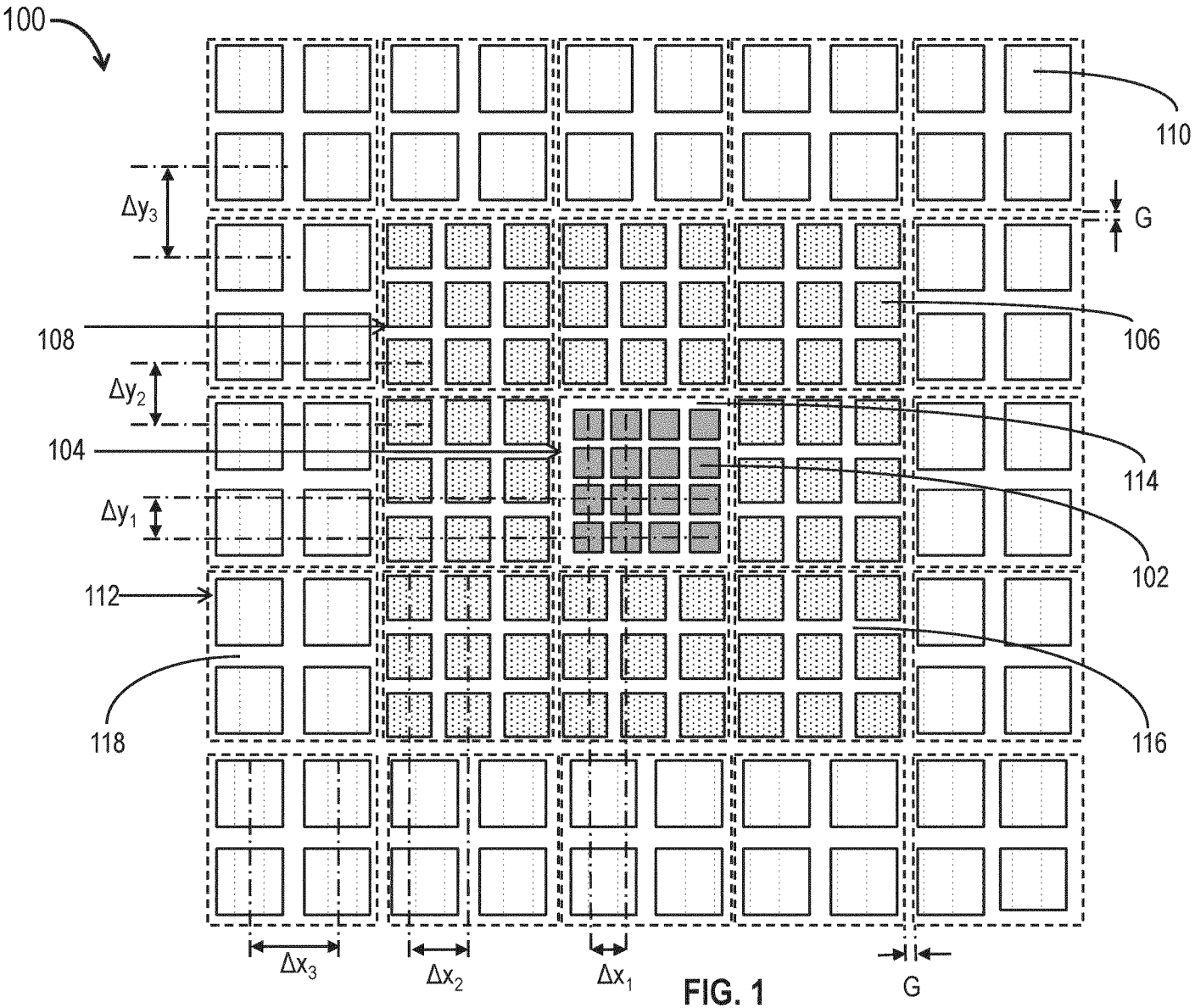
FIG. 1 shows a block diagram illustrating an example embodiment of a wavelength scaled aperture (WSA) antenna array, according to inventive concepts of this disclosure.

The details of various embodiments of the methods and systems are set forth in the accompanying drawings and the description below.

DETAILED DESCRIPTION

Before describing in detail embodiments of the inventive concepts disclosed herein, it should be observed that the inventive concepts disclosed herein include, but are not limited to a novel structural combination of components and circuits, and not to the particular detailed configurations thereof. Accordingly, the structure, methods, functions, control and arrangement of components and circuits have, for the most part, been illustrated in the drawings by readily understandable block representations and schematic diagrams, in order not to obscure the disclosure with structural details which will be readily apparent to those skilled in the art, having the benefit of the description herein. Further, the inventive concepts disclosed herein are not limited to the particular embodiments depicted in the diagrams provided in this disclosure, but should be construed in accordance with the language in the claims.

A wavelength scaled aperture (WSA) antenna array (also referred to herein as wavelength scaled antenna array) can include antenna elements (or radiating elements) of different sizes and/or varying element center-to-element center spacing (also referred to herein as lattice spacing or spacing between adjacent antenna elements), and therefore, can support a given bandwidth (e.g., an UWB or $U^2$WB bandwidth) with a relatively smaller number of antenna elements, for example, compared to non-WSA antenna arrays. The element center-to-element center spacing can increase by a predetermined (or predefined) lattice relaxation factor from one region of the WSA to another region. For instance, the element center-to-element center spacing can increase on the outer regions of the WSA relative to the center of the WSA. The lattice relaxation factor can be defined as the ratio of lattice spacings associated with distinct regions of the WSA. Even for WSA antenna arrays, a large antenna array size or a large number of corresponding antenna elements is still desired to increase antenna gain and enhance spatial discrimination between potentials targets to be detected. However, manufacturing large antenna arrays, such as large active electronically scanned array (AESA) antenna systems, is constrained by many technical challenges.

First, PCB-based antenna arrays, such as PCB-based AESA antenna arrays, are limited in physical size by state-of-the-industry restrictions in PCB material fabrication, PCB etching/lamination processes, and assembly processes for electronic component attachment. Most PCB fabrication equipment is sized for 18"×24" or 21"×24" processing panels. Furthermore, as the PCB increases, issues related to mechanical registration antenna elements become more significant. Specifically, layer-to-layer registration issues are a function of centerline to corner distance within a PCB. Also, additional PCB size restrictions can be imposed relative to automated "pick and place" electronic component-to-PCB attachment equipment for the required radio frequency integrated circuits (RFIC), field gate programmable arrays (FPGA) resistors, capacitors, etc., that are to be placed on the AESA PCB. In addition, PCB based AESA antennas can be warped due to design and processing. The random and deterministic excitation errors across the aperture, due to such warping, increase with PCB panel size. Even when using wafer-scale technology (very large integrated circuit monolithically grown on a radio frequency integrated circuit (RFIC) semiconductor wafer), these technical challenges are still relevant for both extremely low frequency WSAs and extremely high frequency WSAs.

Second, traditional UWB AESA antennas and $U^2WB$ suffer from the lattice "oversampling" problem. For a uniform lattice aperture, for example, the lattice spacing (e.g., the spacing between adjacent antenna elements) is usually set to be equal to half of the shortest wavelength (corresponding to the highest operating frequency) supported by the lattice aperture. The setting of the lattice spacing to be equal to half of the shortest wavelength is a common desing procedure to prevent "grating lobes," (unintended beams acting as false main beams) from forming within the AESA's scan volume. In such case, electronics embedded in the PCB (or RFIC in general) are designed to sample received signals (or process signals to be transmitted) at a sampling rate twice the highest operating frequency. Such hardware design or implementation leads to signal oversampling when the antenna array is operating at lower frequencies (e.g., lower than the highest operating frequency). The large number of antenna elements attached to a PCB (e.g., for UWB and $U^2WB$) together with the oversampling problem can result in hardware problems, such as inefficient DC power consumption, potential heating or overheating, space problems as interconnections between electronic components get exacerbated, and increased weight and cost of the PCB. A relevant parameter with respect to space problems is the RFIC footprint size relative to the inter-element spacing.

Finally, an antenna array, such as an AESA array, can be "sub-arrayed" into a collection of abutted subarrays to overcome the oversampling problem and avoid any constraints imposed due to PCB size restrictions. However, it is technically challenging to physically implement a large array aperture of abutted subarrays while retaining accurate distances between antenna elements across the array. Errors in the distances between antenna elements can result in degraded antenna array performance. Ideally, when abutting subarrays, the antenna elements' spacing defining the array lattice is not to be distorted. However, as a practical manufacturing constraint, subarrays cannot be abutted or tiled together to form the antenna array with zero width gaps between adjacent subarrays. In fact, exiting technology imposes a minimum gap width, referred to herein as $G_{min}$, that can be achieved (or implemented) between adjacent PCBs or subarray panels. That is, $G_{min}$ is the smallest gap width (or minimum spacing) that can be achieved between any pair of adjacent subarrays when abutting or assembling a plurality of antenna subarrays together to form a large antenna array. The value of $G_{min}$ may vary based on the relevant technology used (or available) or based on other factors. However, as long as the width of gaps between adjacent subarrays is greater than zero, such gaps represent distortions to the antenna elements' spacing across the antenna array defined by the abutted subarrays.

Periodic gaps between subarrays manifest themselves as deterministic aperture errors in both analog beamformer (ABF) and digital beamformer (DBF) systems. Specifically, distortion in antenna elements' spacing due to gaps between adjacent subarrays can result in phase (or delay) errors for signals received, or transmitted by, by the antenna elements, increased side lobes' levels, and/or pointing accuracy deterioration. Substantially large gaps between adjacent subarrays (e.g., large enough to exceed a given threshold value or a given fraction of antenna elements' size(s)) introduce grating lobes. In general, the peak side lobe level, as a function of scan, and the root mean square (RMS) side lobe level "noise floor" increases due to these errors. Many antenna systems, such as synthetic aperture radar, fire control radar, and/or other antenna array systems require low side lobe operation. These errors (or performance degradations) due to the gaps between adjacent antenna subarrays are particularly troublesome for UWB and $U^2WB$ antenna arrays which include relatively small antenna elements.

WSA antenna arrays described herein allow for overcoming the technical challenges described above. In particular, an antenna array can include a plurality of antenna subarrays, each having a corresponding plurality of antenna elements, abutted (or tiled) together to form a single WSA antenna array that includes at least two antenna elements of different sizes. The subarrays can be configured and abutted together in a way that gaps between adjacent subarrays occur at regions with relaxed lattice spacing (regions with relatively large lattice spacing) or relaxed antenna elements' size (regions with relatively large antenna elements' size(s)). In particular, for any adjacent pair of antenna subarrays, the lattice spacing (or the antenna element size) for antenna elements adjacent (from at least one side) to the gap between the pair of adjacent subarrays, can be sized to be greater than a predefined size (e.g., a predefined width or length value) that is defined based on $G_{min}$. As the lattice spacing or the size(s) of antenna elements within a region increases, the tolerance for inter-subarray gaps within that region can increase to exceed $G_{min}$ and allow for mitigated antenna array performance degradation due to such gaps. The antenna array system can include one or more beamformer circuits, each of which can be communicatively coupled to at least one of the antenna subarrays.

The use of tiled or abutted antenna subarrays allows for avoiding the size constraints imposed by the PCB size restrictions. Also, the WSA configuration with antenna elements having various sizes allows for supporting a given bandwidth (e.g., an UWB or $U^2WB$) with a reduced number of antenna elements, therefore, overcoming or mitigating the oversampling and hardware problems associated with uniform wavelength antenna arrays. In addition, arranging the inter-subarray gaps to be adjacent to relatively large antenna elements (on at least one side of each gap) mitigates performance degradation due to the inter-subarray gaps.

Referring now to the drawings, FIG. 1 shows a block diagram illustrating an example embodiment of a wavelength scaled aperture (WSA) antenna array 100, according to inventive concepts of this disclosure. The WSA antenna array 100 can include a first plurality of antenna elements 102 forming a high frequency aperture region 104. Each antenna element 102 can have $S_{x1}$ and/or $S_{y1}$ dimensions in the x and y directions, respectively. The spacing(s) between (centerlines of) adjacent pairs of antenna elements 102 can be equal to $\Delta x_1$ along the x-axis and/or $\Delta y_1$ along the y-axis. The dimensions $S_{x1}$ and/or $S_{y1}$ and the spacings $\Delta x_1$ and $\Delta y_1$ can satisfy the equations $\Delta x_1=\Delta y_1=d_1$ and $S_{x1}=S_{y1}=S_1$. The antenna element size $S_1$ can be slightly smaller than the lattice spacing $d_1$. In some implementations, the minimum lattice spacing ($\min(d_1)$) or the minimum antenna element size ($\min(S_1)$) within the high frequency aperture region 104 can be equal to $$\frac{\lambda_1}{2},$$

where $\lambda_1$ is the smallest wavelength supported by the antenna elements 102 or the corresponding aperture region 104. The antenna elements 102 or the corresponding high frequency aperture region 104 can support a high frequency band with a corresponding maximum frequency defined $$f_1 = \frac{c}{\lambda_1} = \frac{c}{2\min(S_1)},$$

where c represents the speed of electromagnetic waves.

The WSA antenna array 100 can include a second plurality of antenna elements 106 forming a mid-frequency aperture region 108. Each antenna element 106 can have $S_{x2}$ and/or $S_{y2}$ dimensions in the x and y directions, respectively. The spacing(s) between (centerlines of) adjacent pairs of antenna elements 106 can be equal to $\Delta x_2$ along the x-axis and/or $\Delta y_2$ along the y-axis. The dimensions $S_{x2}$ and/or $S_{y2}$ and the spacings $\Delta x_2$ and $\Delta y_2$ can satisfy the equations $\Delta x_2=\Delta y_2=d_2$ and $S_{x2}=S_{y2}=S_2$. The antenna element size $S_2$ can be slightly smaller than the lattice spacing $d_2$. In some implementations, the minimum lattice spacing ($\min(d_2)$) or the minimum antenna element size ($\min(2_1)$) within the mid-frequency aperture region 108 can be equal to $$\frac{\lambda_2}{2},$$

where $\lambda_2$ is the smallest wavelength supported by the antenna elements 106 or the corresponding mid-frequency aperture region 108. The antenna elements 106 or the corresponding mid-frequency aperture region 108 can support a mid-frequency subband with a corresponding maximum frequency defined as $$f_2 = \frac{c}{\lambda_2} = \frac{c}{2\min(S_2)}.$$

The antenna elements 106 can have a size $S_2$ larger than the size $S_1$ of the antenna elements 102, the wavelength $\lambda_2$ can be larger than the wavelength $\lambda_1$, and the frequency $f_2$ can be smaller than the frequency $f_1$.

The WSA antenna array 100 can include a third plurality of antenna elements 110 forming a low frequency aperture region 112. Each antenna element 110 can have $S_{x3}$ and/or $S_{y3}$ dimensions in the x and y directions, respectively. The spacing(s) between (centerlines of) adjacent pairs of antenna elements 110 can be equal to $\Delta x_3$ along the x-axis and/or $\Delta y_3$ along the y-axis. The dimensions $S_{x3}$ and/or $S_{y3}$ and the spacing(s) $\Delta x_3$ and $\Delta y_3$ can satisfy the equations $\Delta x_3=\Delta y_3=3$ and $S_{x3}=S_{y3}=S_3$. The antenna element size $S_3$ can be slightly smaller than the lattice spacing $d_3$. In some implementations, the minimum lattice spacing ($\min(d_3)$) or the minimum antenna element size ($\min(3_1)$) within the low frequency aperture region 112 can be equal to $$\frac{\lambda_3}{2},,$$

where $\lambda_3$ is the smallest wavelength supported by the antenna elements 110 or the corresponding low frequency aperture region 112. The antenna elements 110 or the corresponding low frequency aperture region 112 can support a low frequency subband with a corresponding maximum frequency defined as $$f_3 = \frac{c}{\lambda_3} = \frac{c}{2\min(S_3)}.$$

The antenna elements 110 can have a size $S_3$ larger than the size S2 of the antenna elements 106, the wavelength $\lambda_3$ can be larger than the wavelength $\lambda_2$, and the frequency $f_3$ can be smaller than the frequency $f_2$.

The high frequency aperture region 104 can include a first antenna subarray 114. The first antenna subarray 114 can be a subarray panel including the first plurality of antenna elements 102 mounted on a corresponding PCB (not shown in FIG. 1), for example. The mid-frequency aperture region 108 can include a plurality of second antenna subarrays 116. Each second antenna subarray 116 can be a subarray panel including a number of the second antenna elements 106 mounted on a corresponding PCB (not shown in FIG. 1), for example. The low frequency aperture region 112 can include a plurality of third antenna subarrays 118. Each third antenna subarray 118 can be a subarray panel including a number of the third antenna elements 110 mounted on a corresponding PCB (not shown in FIG. 1), for example. The subarray panels 114, 116, and 118 can be abutted (or tiled) together to form the WSA antenna array 100. In particular, the aperture regions 104, 108, and 112 can be arranged as concentric regions with the mid-frequency aperture region 108 surrounding the high frequency aperture region 104, and the low frequency aperture region 112 surrounding the mid-frequency aperture region 108. As used herein, an aperture region (such as aperture region 104, 108, or 112) can be a group of discontinuous regions associated with (or hosting) similar antenna elements. The antenna subarrays of the same aperture region or of distinct aperture regions may have different numbers of antenna elements. The shape of an antenna subarray may be a rectangle, square, pentagon, hexagon, octagon, "+" shape, or other shape. Also, while in FIG. 1 the antenna element size and the spacing between adjacent antenna elements are shown to be uniform within each aperture region, both the antenna element size or spacing between adjacent antenna elements can vary within a single aperture region or within a single antenna subarray.

Each pair of subarray panels, among the subarray panels 114, 116, and 118, can be separated by a corresponding gap having a gap width equal to a value G. As discussed above, due to manufacturing constraints, the value G satisfies $G \geq G_{min}$, where $G_{min}$ represents the smallest achievable (or implementable) gap width between any pair of adjacent subarray panels. Also, in order to mitigate any potential performance degradation of the antenna array 100 due to the inter-subarray gaps, the gap width G of any inter-subarray gap can be upper bounded by a corresponding upper bound value, for example, to satisfy a performance constraint (e.g., based on a performance criterion). Such upper bound value can be defined in terms of a wavelength associated with one of the adjacent subarray panels separated by the gap, the size(s) of antenna elements arranged adjacent to the gap along at least one elongated boundary of the gap, or lattice spacing associated with antenna elements arranged adjacent to the gap along at least one elongated boundary of the gap. The performance constraint can be defined based on a given performance criterion (or criterion factor), such as ratio between main lobe and peak side lobes, an For example, the gap width G can be constrained to satisfy $$G \leq \frac{\lambda}{N},$$

where $\lambda$ is a wavelength associated with one of the adjacent subarrays separated by the gap, and N is a number. The number N may be selected (or determined) in a way to achieve a specified performance criterion. For instance, $\lambda$ can the larger wavelength among wavelengths associated with the pair of adjacent subarrays separated by the gap (e.g., $\lambda$ can be equal to $\lambda_2$ for a gap separating a subarray 114 and a subarray 116, or can be equal to $\lambda_3$ for a gap separating a subarray 116 and a subarray 118). The number N may be determined so that to achieve, for example, a minimum difference (in dBs) between the main lobe and peak side lobes. For example, N can be equal to 16 to achieve a −30 dBp (relative to main beam peak) side lobe level at the highest operating frequency (gaps between antenna subarrays can be smaller than or equal to 1/16 of a $\lambda_1$).

In another example, the gap width G can be constrained to satisfy $$G \leq \frac{S}{M},$$

where S represents an antenna element size or a lattice spacing associated with antenna elements adjacent to the gap along at least one elongated boundary of the gap, and M is a number. For instance, for a gap separating a first and second adjacent antenna subarrays, a first set of antenna elements (having a size $W_1$) of the first antenna subarray can be arranged adjacent to the gap along a first boundary of the gap, and a second set of antenna elements (having a size $W_2$) of the second antenna subarray can be arranged adjacent to the gap along a second boundary of the gap. The size S can be equal to $\max(W_1,W_1)$, where max( ) represents the maximum function. For example, S can be equal to $S_2$ for a gap separating an antenna subarray 114 and an antenna subarray 116, or can be equal to $S_3$ for a gap separating an antenna subarray 116 and an antenna subarray 118). The number M may be defined based on a specified performance criterion (e.g., side lobe level relative to main lobe of the WSA antenna array) of the WSA antenna array 100. to achieve, for example, a minimum difference (in dBs) between the main lobe and peak side lobes (e.g., M can be equal to 8 to achieve at least a 30 dB difference between main lobe magnitude and peak side lobes magnitude(s)), or may be determined to ensures all side lobes have a magnitude smaller than predefined value. In yet another example, G may be constrained to be smaller than or equal to some other function h(S) of S (e.g., other than S/M). The value of any of the parameters N or M, or the function of S can be determined through computer simulations, mathematical calculations, or using other techniques known to a person skilled in the relevant art.

Considering both constraints on the gap width $$G\left(\text{e.g., } G_{min} \leq G \leq \frac{S}{M}\right),$$

for any pair of adjacent subarrays, one of the pair of subarrays has to include antenna elements that satisfy $$G_{min} \leq \frac{S}{M}.$$

For example, if only $S_2$ and $S_3$ satisfy this constraint but $S_1$ does not, then any pair of adjacent subarrays has to include either a subarray 116 or a subarray 118. As such, abutting two subarrays 114 adjacent to each other would at best lead to gap width equal to $G_{min}$ that still violates the antenna array performance constraint since $$G_{min} > \frac{S_1}{M}.$$

In order to avoid such violations, the subarrays 112, 114 and 116 are arranged (or abutted) such that no two subarrays 114 are tiled (or abutted) to be adjacent to each other.

When building a WSA antenna array by abutting (or assembling) a plurality of given subarrays, one can abut (or tile) the subarrays such that inter-subarray gaps meet the manufacturing constraint for such gaps $G_{min} \leq G$ and any predefined or specified antenna array performance constraint $$\left(\text{e.g., } G \leq \frac{S}{M}\right).$$

In other words, when abutting (or tiling) the subarrays, antenna elements adjacent to any inter-subarray gap along one of the elongated boundaries of that gap (e.g., antenna elements adjacent to the gap within one of the adjacent subarrays separated by the gap) have size(s) S large enough to allow for a gap width G that satisfies, for example, $$G_{min} \leq G \leq \frac{S}{M} \text{ (or } G_{min} \leq G \leq h(S),$$

where h is a specified function). Also, in designing the antenna subarrays to be abutted (or tiled, or assembled) together, one can design a sufficient number of antenna subarrays with corresponding outer antenna elements (antenna elements at the boundary of the antenna subarray) that satisfy the constraint $$G_{min} \leq \frac{S}{M}.$$

The gap width G may not be constant for all inter-subarray gaps. For instance, the gap width G may be different along the x-axis and along the y-axis. Also, the gap width G may vary for various pairs of adjacent antenna subarrays. For example, the gap width of a gap between an antenna subarray 114 and an antenna subarray 116 may be different from the gap width of a gap between an antenna subarray 116 and an antenna subarray 118. Furthermore, while FIG. 1, shows three different aperture regions 104, 108, and 112, the WSA antenna array 100 (or other WSA antenna arrays described in the current disclosure) may include any number of aperture regions (each associated with a corresponding antenna elements' size) greater than or equal to two.

In some embodiments, the constraints on G may be defined in terms of the spacing between adjacent antenna elements, e.g., Δx and/or Δy, associated with antenna elements arranged at the boundaries of adjacent antenna subarrays. For example, G may be constrained to satisfy $$G_{min} \leq G \leq \frac{\Delta x}{M}$$

for a pair or adjacent antenna subarrays separated by a gap aligned along the y-axis, or satisfy $$G_{min} \leq G \leq \frac{\Delta x}{M}$$

for a pair of adjacent antenna subarrays separated by a gap aligned along the x-axis. In other words, antenna subarrays are designed and assembled (or tiled) such that gaps separating (or adjacent edges of) adjacent antenna subarrays are arranged along regions characterized by relaxed (or relatively large) spacings between adjacent antenna elements. As such, the distortions applied to the spacings between adjacent antenna elements due to the gaps separating adjacent antenna subarrays can be relatively small compared to such spacings since $$G \leq \frac{\Delta x}{M} \text{ or } G \leq \frac{\Delta y}{M}.$$

By reducing the distortions (relative to the corresponding spacings), the effect of such distortions on the performance of the WSA antenna array 100 can be mitigated as peak side lobes level (SLL) are reduced, grating lobes are avoided (or mitigated), and degradation to antenna array gain and beam is reduced.

Each of the high frequency aperture region 104, the mid-frequency aperture region 108, and the low frequency aperture region 112 can be configured to operate at a corresponding frequency subband. As an illustrative example, the high frequency aperture region 104 (or the first plurality of antenna elements 102) can be configured to operate at a 500 MHz frequency subband centered at 18 GHz, the mid-frequency aperture region 108 (or the second plurality of antenna elements 106) can be configured to operate at a 500 MHz frequency subband centered at 9 GHz, and the low frequency aperture region 112 (or the third plurality of antenna elements 110) can be configured to operate at a 500 MHz frequency subband centered at 2 GHz. The sizes and center frequencies of the frequency subbands may be designed differently. Also, the number of such frequency subbands can vary (not necessarily three subbands) according to the number of aperture regions in the WSA antenna array 100.

Figure 2A:
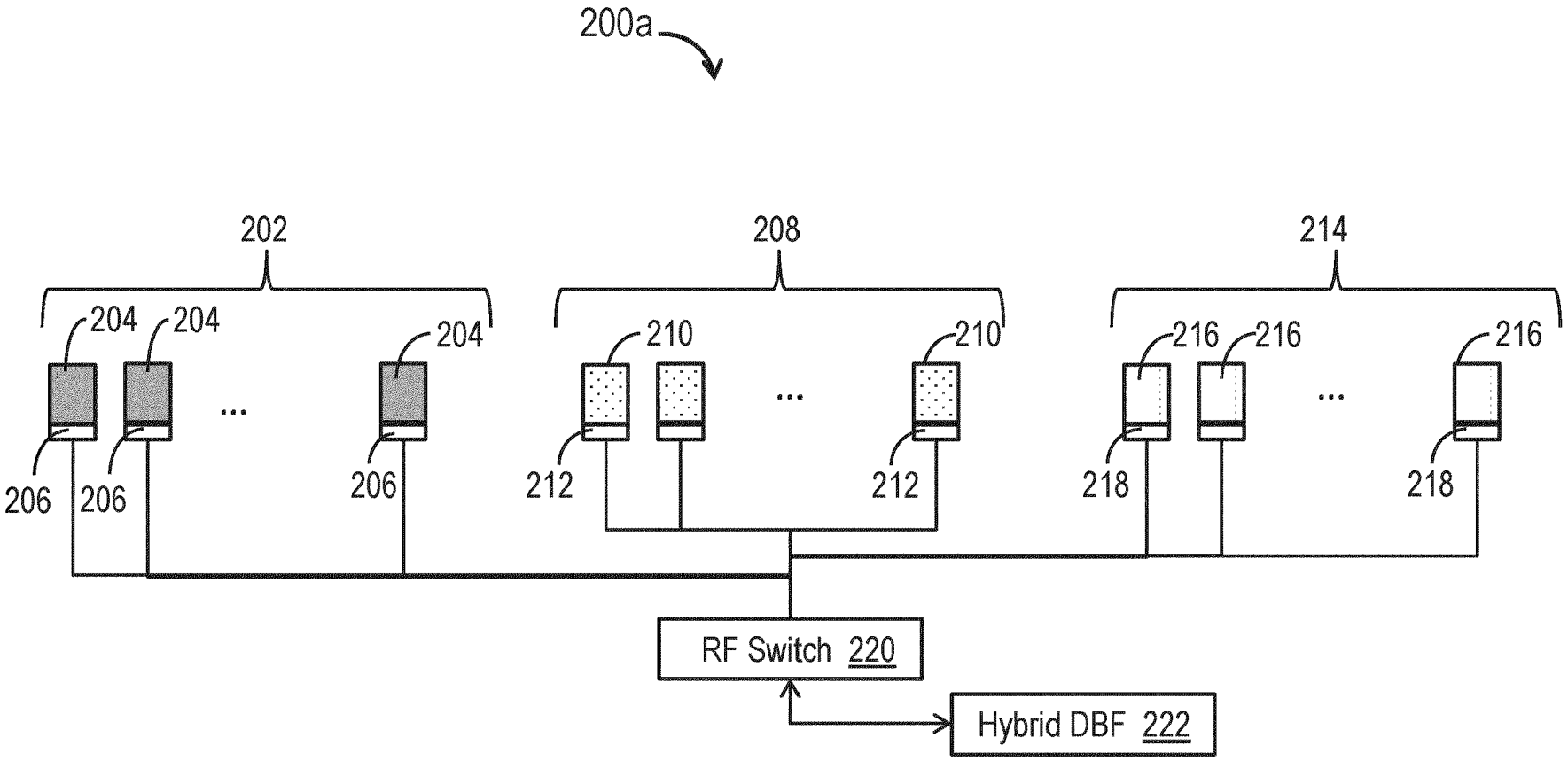
FIGS. 2A-C show block diagrams illustrating example embodiments of various WSA antenna arrays with distinct example beamformer circuits, according to inventive concepts of this disclosure.
Figure 2B:
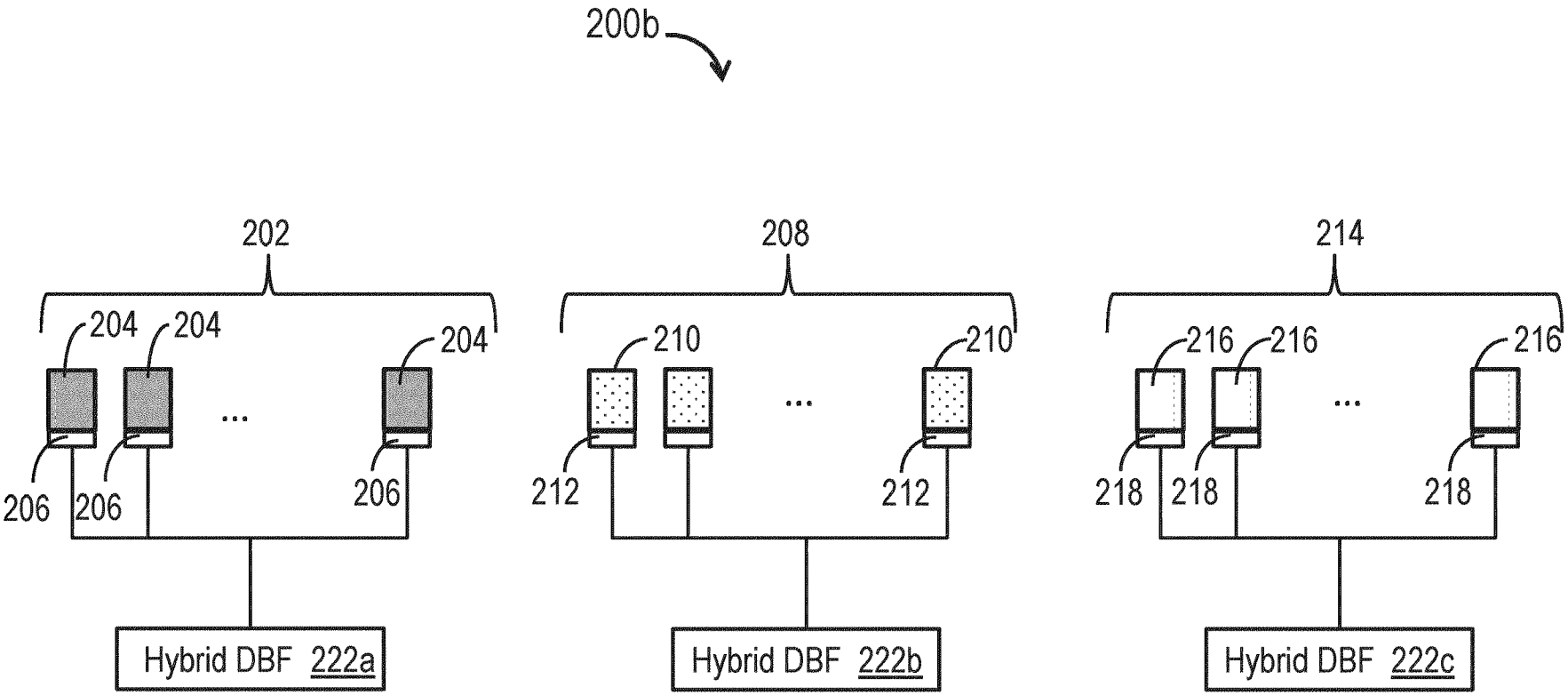
Figure 2C:
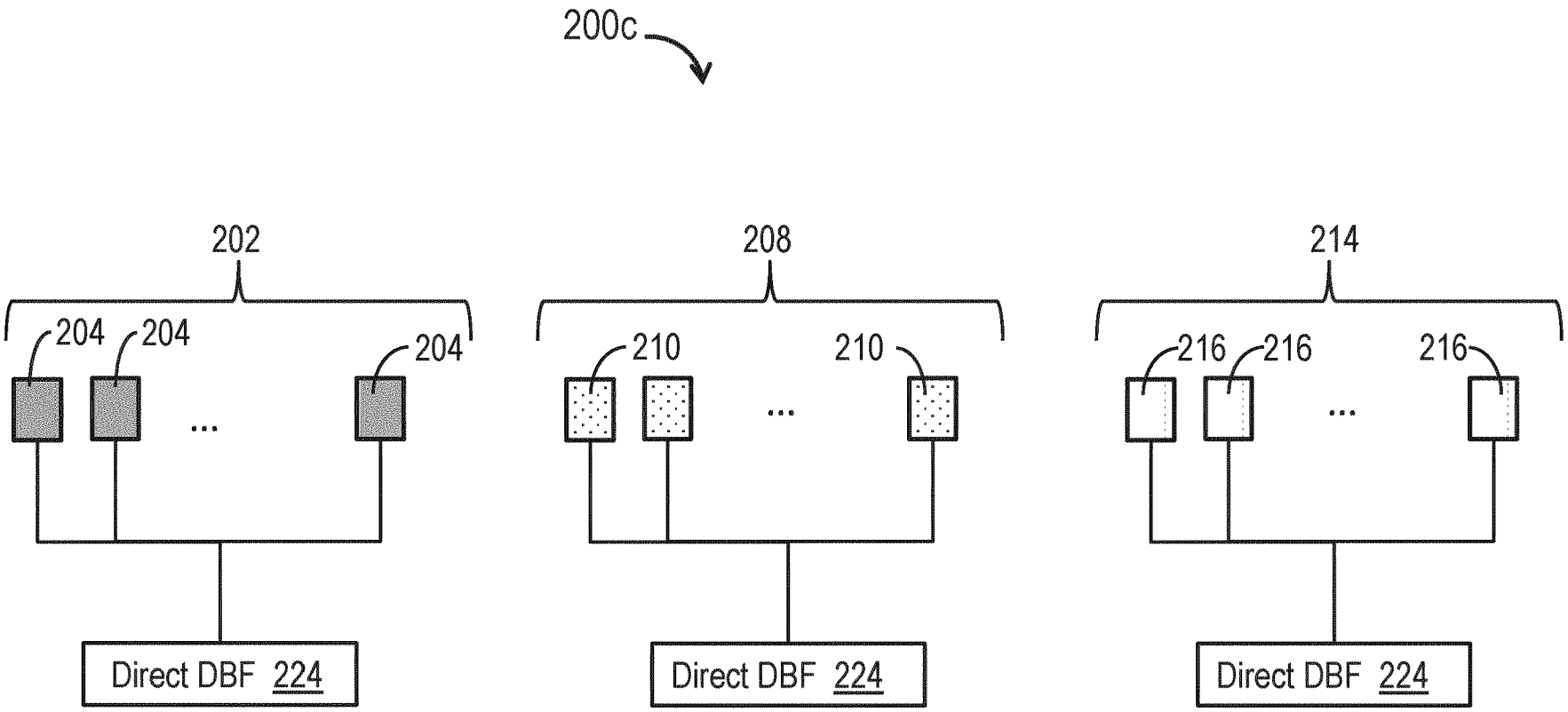

Referring to FIGS. 2A-C, block diagrams illustrating example embodiments of various WSA antenna arrays 200*a-c* with distinct example beamformer circuits are shown, according to inventive concepts of this disclosure. In brief, the WSA antenna array 200*a*, shown in FIG. 2A, can include a high frequency aperture region 202 including one or more corresponding antenna subarrays 204 each of which including one or more corresponding analog beamformer (ABF) 206 (also referred to as ABF circuit 206), a mid-frequency aperture region 208 including one or more corresponding antenna subarrays 210 each of which including one or more corresponding analog beamformer(s) (ABF) 212 (also referred to as ABF circuit(s) 212), and a low frequency aperture region 214 including one or more corresponding antenna subarrays 216 each of which including one or more corresponding analog beamformer(s) (ABF) 218 (also referred to as ABF circuit(s) 218). The WSA antenna array 200*a* can also include a radio frequency (RF) switch 220 communicatively coupled to the ABF circuits 206, 212, and 218, and a hybrid digital beamformer (DBF) 222 (also referred to as DBF circuit 222) communicatively coupled to the RF switch 220.

The antenna subarrays 204, 210, and 216 can be abutted (or tiled) together as discussed above with regard to FIG. 1 or according to any abutting (or tiling) configuration described or contemplated by the current disclosure. Specifically, the antenna subarrays 204, 210, and 216 can be abutted (or tiled) together such that for any pair of adjacent antenna subarrays separated by a corresponding gap, the antenna elements adjacent to the gap (along at least one elongated boundary of the gap) have size(s) (or are associated with lattice spacing) greater than or equal to a predefined value defined based on $$G_{min}\left(\text{e.g., } G_{min} \leq \frac{S}{M}, \text{ or } G_{min} \leq h(S)\right.$$

as discussed above with regard to FIG. 1).

Each antenna subarray 204 can include one or more corresponding ABF circuits 206 (also referred to herein as partial ABF(s) 206). Each partial ABF 206 can be coupled to at least a subset of the antenna elements of the corresponding antenna subarray 204, and can include a plurality of analog transmit receive modules (TRMs). Each TRM can be associated with (or connected to) a corresponding antenna element of the subset of antenna elements to which the partial ABF 206 is connected. Each TRM can include a RF amplifier and a time (or phase) shifter. Each partial ABF circuit 206 can include one or more power combiners (or power accumulators) and one or more power splitters (or power dividers). Also, each ABF circuit 206 can include (or can be connected to) an analog-to-digital converter (ADC) to convert output signals of the ABF circuit 206 to corresponding digital signals to be fed to the hybrid DBF 222 (through the RF switch 220), and a digital-to-analog converter (DAC) to convert digital signals received from the hybrid DBF 222 (through the RF switch 220) to corresponding analog signals fed as input to the ABF circuit 206. Each ABF circuit 206 can include an up/down converter circuit to frequency shift analog signals before sampling by the ADC or after analog conversion by the DAC. The partial ABF circuit 206 can be integrated within the PCB of the corresponding antenna subarray 204.

In the receive mode of the WSA antenna array 202*a*, the ABF circuits 206 transform signals received by the antenna elements of the high frequency aperture region 202 into a plurality of beam signals (e.g., equal the number of ABF circuits 206). That is, each ABF circuit 206 can transform (e.g., by applying RF amplification, time/phase shifting, and power accumulation) signals received by antenna elements connected to that ABF circuit 206 to a corresponding beam signal. For each output beam signal of the ABF circuits 206, a corresponding RF down conversion circuit can down convert that output beam signal to generate a corresponding intermediate frequency (IF) signal having a maximum frequency that is compatible with the ADC circuit coupled to the corresponding channel of the hybrid DBF 222. The maximum frequency of each IF signal is smaller than or equal to half the maximum sampling frequency of the ADC. The RF down conversion circuits can be integrated in PCBs of the subarray panels or other circuit boards coupled to the PCBs of the subarray panels. The IF signal for each corresponding output beam signal of the ABF circuits 206 can be sampled by the ADC and fed to the hybrid DBF 222 through the RF switch 220. In the transmit mode of the WSA antenna array 202*a*, a digital exciter beam signal (for a group of antenna elements coupled to a single ABF circuit 206) can be converted by a DAC circuit to an IF analog signal. An up conversion circuit can up convert the analog IF signal to a higer frequency band conforming with a frequency subband associated with the subarray panel (e.g., subarray 204, 210, or 216) to receive the up converted signal. Each ABF circuit 206 can receive a corresponding up converted IF analog signal (corresponding to a digital exciter beam signal from the hybrid DBF 220), and split the received analog signal into a plurality of time/phase shifted and/or RF amplified analog signals that are transmitted by the antenna elements connected to the ABF circuit 206.

The ABF circuits 212 and the ABF circuits 218 can include similar components (e.g., time/phase shifters, RF amplifiers, a power combiner, a power splitter, ADC, DAC, etc.) as the ABF circuits 206. In some implementations, the up/down converter circuit may not be implemented in the ABF circuits 212 or ABF circuits 218 if the corresponding ADCs and DACs are capable of operating at frequencies satisfying the Nyquist rate for the mid-frequency subband or the high frequency subband. The ABF circuits 212 and the ABF circuits 218 can operate in similar way (in receive or transmit modes) as described above with respect to the ABF circuits 206.

The RF switch 220 can be communicatively coupled to the ABF circuits 206, 212, and 212 associated with the antenna subarrays 204, 210, and 216, and to the hybrid digital DBF circuit 222. The RF switch 220 can alternately connect the hybrid DBF circuit 220 to separate groups of the ABF circuits 206, 212, and 212 associated with the antenna subarrays 204, 210, and 216. Specifically, while all aperture regions 202, 208, and 214 are in active state, the RF switch 220 can connect the hybrid DBF circuit 220 to separate groups of the partial ABF circuits 206, 212, and 212 according to a time division multiplexing scheme. For instance, the RF switch 220 can, at a first time interval, connect the hybrid DBF circuit 220 to ABF circuits 206 associated with high frequency aperture region 202. At a second time interval (e.g., consequent to the first time interval), the RF switch 220 can disconnect the hybrid DBF circuit 220 from partial ABF circuits 206 and connect it to ABF circuits 210 associated with mid-frequency aperture region 208. At a third time interval (e.g., consequent to the second time interval), the RF switch 220 can disconnect the hybrid DBF circuit 220 from ABF circuits 210 and connect it to ABF circuits 218 associated with mid-frequency aperture region 214. That is, at any given time, the hybrid DBF circuit 222 can be connected to ABF circuits from a single aperture region.

The hybrid DBF 222 can include a fixed number K (K is an integer) of channels that are configured to be simultaneously tuned to the same center frequency. The number of partial ABF circuits 206 in the high frequency aperture region 202 can be equal to K, the number of partial ABF circuits 212 in the mid frequency aperture 208 region can be equal to K, and the number of partial ABF circuits 218 in the low frequency aperture region 214 can be equal to K. Also, the RF switch 220 can include K bidirectional channels, or 2K unidirectional channels. In the receive mode of the WSA antenna array 202*a*, the hybrid DBF 222 can receive "partial" beam signals output by ABF circuits 206, 210, or 218 associated with one of the aperture regions 202, 208, or 214. Each partial beam signal output by a corresponding ABF circuit (e.g., ABF circuit 206) represents a beam signal formed using signals received by only a subset of the antenna elements in the corresponding aperture region (e.g., high frequency aperture region 202). The hybrid DBF circuit 222 can generate, for each aperture region 202, 208, or 214, a single corresponding beam signal based on the received partial beam signals output by the ABF circuits associated with that aperture region. For instance, the hybrid DBF circuit 222 can receive, as input, partial beam signals output by the ABF circuits 206 and generate a corresponding output beam signal for the entire high frequency aperture region 202. The hybrid DBF 222 can time (or phase) shift and/or amplify (in the digital domain) the partial beam signals, and then accumulate (or add) them into a single digital beam signal for the corresponding aperture region. As such each digital beam signal generated by the hybrid DBF circuit 222 can be viewed as a beam signal formed from signals received by all antenna elements in a corresponding aperture region.

In the transmit mode, the hybrid DBF circuit 222 can split a digital beam signal into multiple partial beam signals to be provided to ABF circuits of a given aperture region. The hybrid DBF circuit 222 can apply separate time (or phase) shifting and/or power (or amplitude) amplification to the split partial beam signals. The hybrid DBF circuit 222 can provide the generated digital partial beam signals to the ABF circuits of one of the aperture regions via the RF switch 220. Each ABF circuit (or a corresponding DAC) can convert the received digital partial beam signal into a corresponding analog signal, power split the analog signal into multiple signals, and apply further time (or phase) shifts and/or RF amplification to the multiple split signals. Each of the multiple split signals can then be transmitted by a corresponding antenna element connected to ABF circuit. The hybrid DBF circuit 222 can account for transmission delay between partial beam signals associated with separate aperture regions, for example, by introducing additional time/phase shifts to partial beam signals provided later in time than other partial beam signals to the ABF circuits.

The combination of the hybrid DBF circuit 222 together with the ABF circuits 206, 210, and/or 218 can be viewed as a hybrid beamforming system with part of the beamforming process performed in the analog domain by the ABF circuits 206, 210, or 218 and another part performed in the digital domain by the hybrid DBF circuit 222. The hybrid DBF circuit 222 can include a general purpose microprocessor, a digital signal processor (DSP), an application-specific instruction set processor, an integrated circuit, or a combination thereof. The hybrid DBF circuit 222 and/or the RF switch 220 can be integrated in a PCB of one of the antenna subarrays 204, 210 or 216, or can be integrated on a separate circuit board.

The WSA antenna array 200*b* in FIG. 2B is similar to the WSA antenna array 200*a*, except that instead of employing a RF switch, the WSA antenna array 200*b* can include multiple hybrid DBF circuits 222*a-c* each of which connected to ABF circuits in a corresponding aperture region. For instance, the hybrid DBF circuit 222*a* can be connected to ABF circuits 206 in the high frequency aperture region 202, the hybrid DBF circuit 222*b* can be connected to ABF circuits 212 in the mid-frequency aperture region 208, and the hybrid DBF circuit 222*c* can be connected to ABF circuits 218 in the low frequency aperture region 214. The hybrid DBF circuits 222*a-c* can be similar to, and can operate in a similar way as, the hybrid DBF circuit 222. However, the hybrid DBF circuits 222*a-c* do not need to account for delays in the transmission of partial stream signals to separate aperture regions since the hybrid DBF circuits 222*a-c* can simultaneously transmit (or receive) partial stream signals to (or from) ABF circuits 206, 212, and 218, respectively.

The hybrid DBF circuit 222*a* can be integrated in a PCB of one of the antenna subarrays 204, the hybrid DBF circuit 222*b* can be integrated in a PCB of one of the antenna subarrays 210, and the hybrid DBF circuit 222*c* can be integrated in a PCB of one of the antenna subarrays 216. In some example implementations, the hybrid DBF circuits 222*a-c* can be integrated on a separate circuit board different from PCBs of the antenna subarrays 204, 210, and 216. The use of hybrid DBF circuits as illustrated in FIGS. 2A and 2B can help mitigate the circuit compaction problem (e.g., exacerbated space for electric components and electric interconnections) in PCBs by reducing the number of circuit components integrated on (or within) each PCB of a corresponding antenna subarray.

Referring to FIG. 2C, a WSA antenna array 200*c* employing one or more direct DBF circuits 224 is shown, according to inventive concepts of this disclosure. Similar to the WSA antenna arrays 200*a* and 200*b*, the WSA antenna array 200*c* can include a plurality of antenna subarrays 204, 210, and 216 forming, respectively, high frequency aperture region 202, mid-frequency aperture region 208, and low frequency aperture region 214. Every antenna (or radiating) element in each of the antenna subarrays 204, 210, and 216 can be connected to a corresponding low noise amplifier (LNA) and a corresponding ADC in the receive mode, and to a corresponding DAC, a corresponding exciter, and a corresponding power amplifier (PA) in the transmit mode. These electric components can be integrated within a PCB of the corresponding antenna subarray 204, 210, or 218.

Each direct DBF circuit 224 can include (or can be coupled to) an ADC circuit and a DAC circuit with a corresponding maximum sampling frequency (or maximum operating frequency) equal to or exceeding twice the largest frequency supported by antenna elements coupled to that direct DBF circuit 224. In the receive mode, signals received by antenna elements of a given antenna subarray can be sampled by corresponding ADCs, and the corresponding digital signals can be provided as input to a direct DBF circuit 224 connected to that antenna subarray. In the transmit mode, the direct DBF circuit(s) 224 can provide, for each antenna element of the WSA antenna array 200*c*, a separate digital signal for transmission by that antenna element. The digital signal can be converted to a corresponding analog signal by the corresponding exciter and the corresponding DAC. The resulting analog signal can be amplified the corresponding PA before being transmitted by the antenna element.

In the receive mode of the WSA antenna array 200*c*, each direct DBF circuit 224 can receive a plurality of digital signals corresponding to a plurality of analog signals received by antenna elements connected to that direct DBF circuit 224. The direct DBF circuit 224 can perform beamforming processes (e.g., time/phase shifting, signal amplification, signals accumulation), in the digital domain, to generate one or more output beam signals. For example, the direct DBF circuit 224 connected to the antenna elements in antenna subarrays 204 can generate a single output beam signal for the high frequency aperture region 202, the direct DBF circuit 224 connected to the antenna elements in antenna subarrays 210 can generate a single output beam signal for the mid-frequency aperture region 208, and the direct DBF circuit 224 connected to the antenna elements in antenna subarrays 216 can generate a single output beam signal for the low frequency aperture region 214. In the transmit mode, each direct DBF circuit 224 can generate, each antenna element connected to it, a corresponding digital signal (e.g., properly time/phase shifted and/or amplified) that is converted to a corresponding analog signal and transmitted by that antenna element.

The term "direct" in "direct DBF circuit" implies that the direct DBF circuit(s) 224 can be connected to antenna elements of the WSA antenna array 200*c* without ABF circuits in between. As such, beamforming processes (in receive or transmit mode) can be fully performed in the digital domain by the direct DBF circuit(s) 224. According to the illustration in FIG. 2C, for each aperture region 202, 208, or 214 (or frequency subband), a corresponding direct DBF circuit 224 can be connected to antenna elements of that aperture region, and can be configured to generate a single output beam signal (in the receive mode) for that aperture region. Other configurations of employing the direct DBF circuit 224 are contemplated by this disclosure.

The direct DBF circuit(s) 224 can provide flexibility with regard to the number of channels (or antenna elements) supported, can allow for simultaneous operation at distinct center frequencies, and can allow for interconnections across multiple antenna subarrays. These features allow for various connection configurations between the direct DBF circuit(s) 224 and antenna elements of the WSA antenna array 200*c*. For example, a single DBF circuit 224 can be connected to all antenna elements of the WSA antenna array 202*c*. In general, a direct DBF circuit 224 can be connected to antenna elements associated with distinct aperture regions or operating at different center frequencies (or at different frequency subbands). In such case, the DBF circuit 224 can generate multiple output beam signals (in the receive mode), each associated with a corresponding aperture region (or a corresponding frequency subband). In the transmit mode, the direct DBF circuit 224 can provide digital signals with different center frequencies for transmission by antenna elements having different sizes. In other words, the direct DBF circuit 224 can act as multiple parallel beamformers for multiple center frequencies (or multiple subbands).

A direct DBF circuit 224 can include a general purpose microprocessor, a digital signal processor (DSP), an application-specific instruction set processor, an integrated circuit, or a combination thereof. The direct DBF circuit(s) 224 can be implemented as software, hardware, firmware, or a combination thereof. The direct DBF circuit(s) 224 can be integrated in a PCB of one of the antenna subarrays 204, 210 or 216, or can be integrated on a separate circuit board.

Figure 3A:
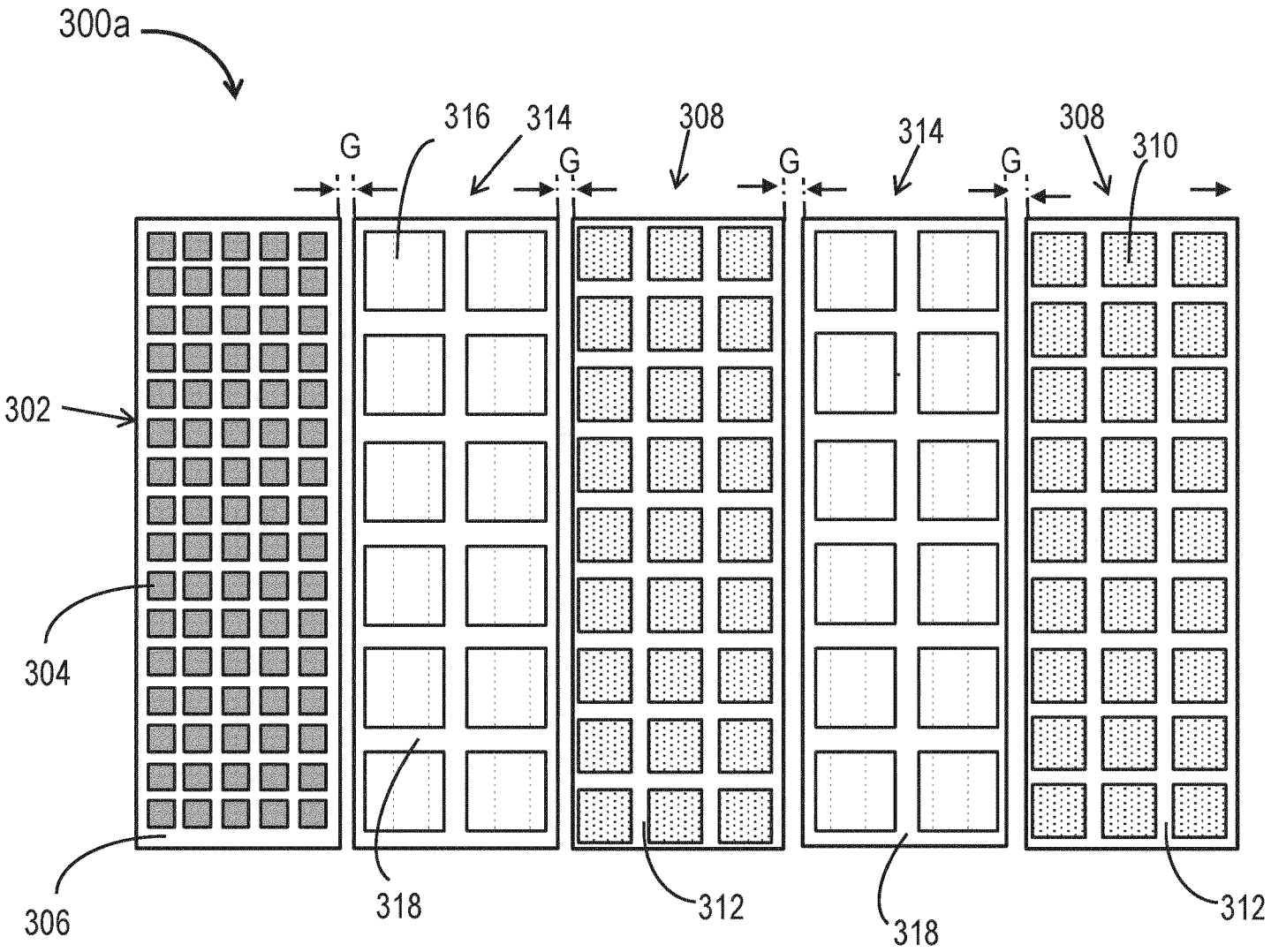
FIGS. 3A-C show block diagrams illustrating example embodiments of various tiling configurations of antenna subarrays within WSA antenna arrays, according to inventive concepts of this disclosure.
Figure 3B:
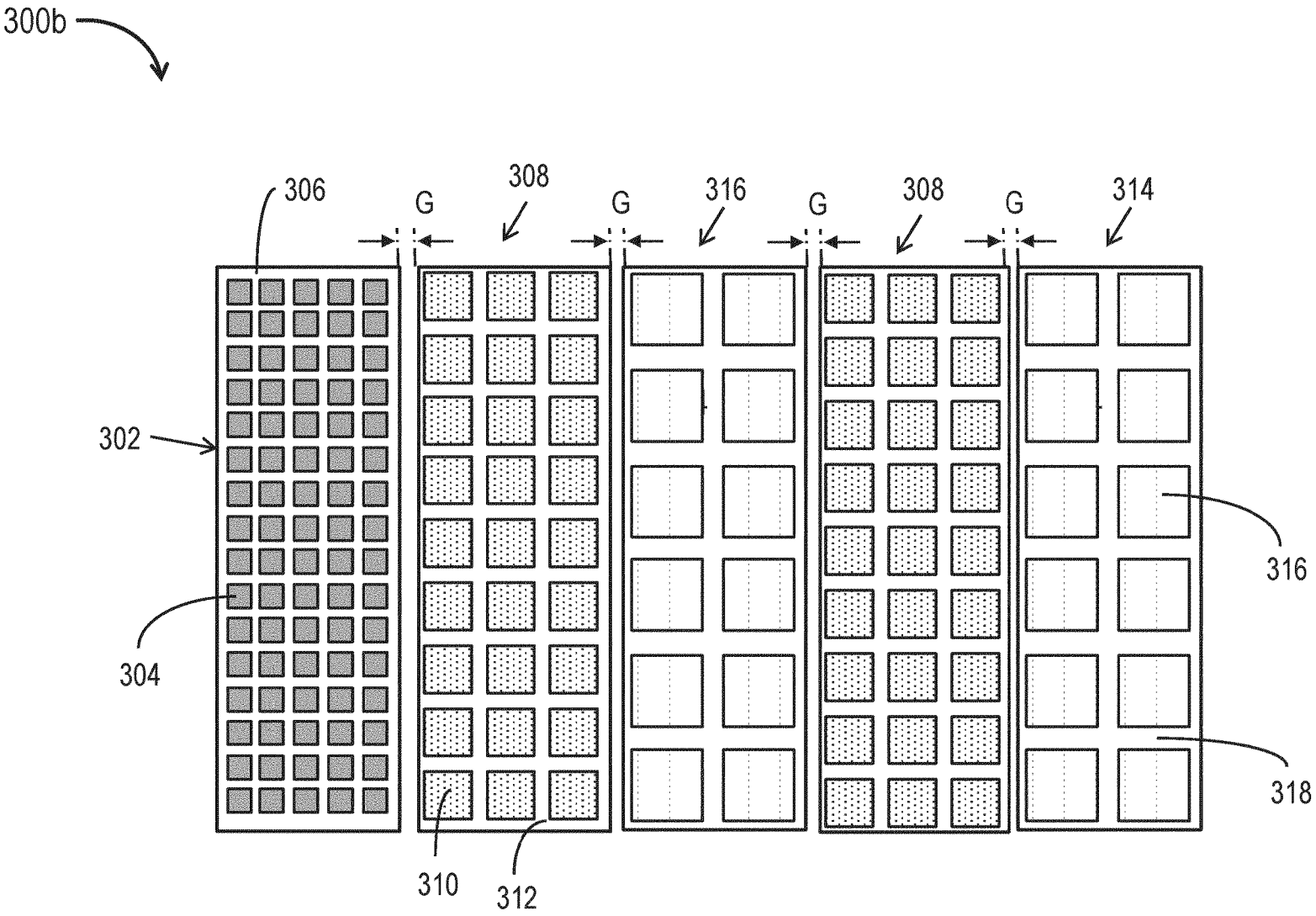
Figure 3C:
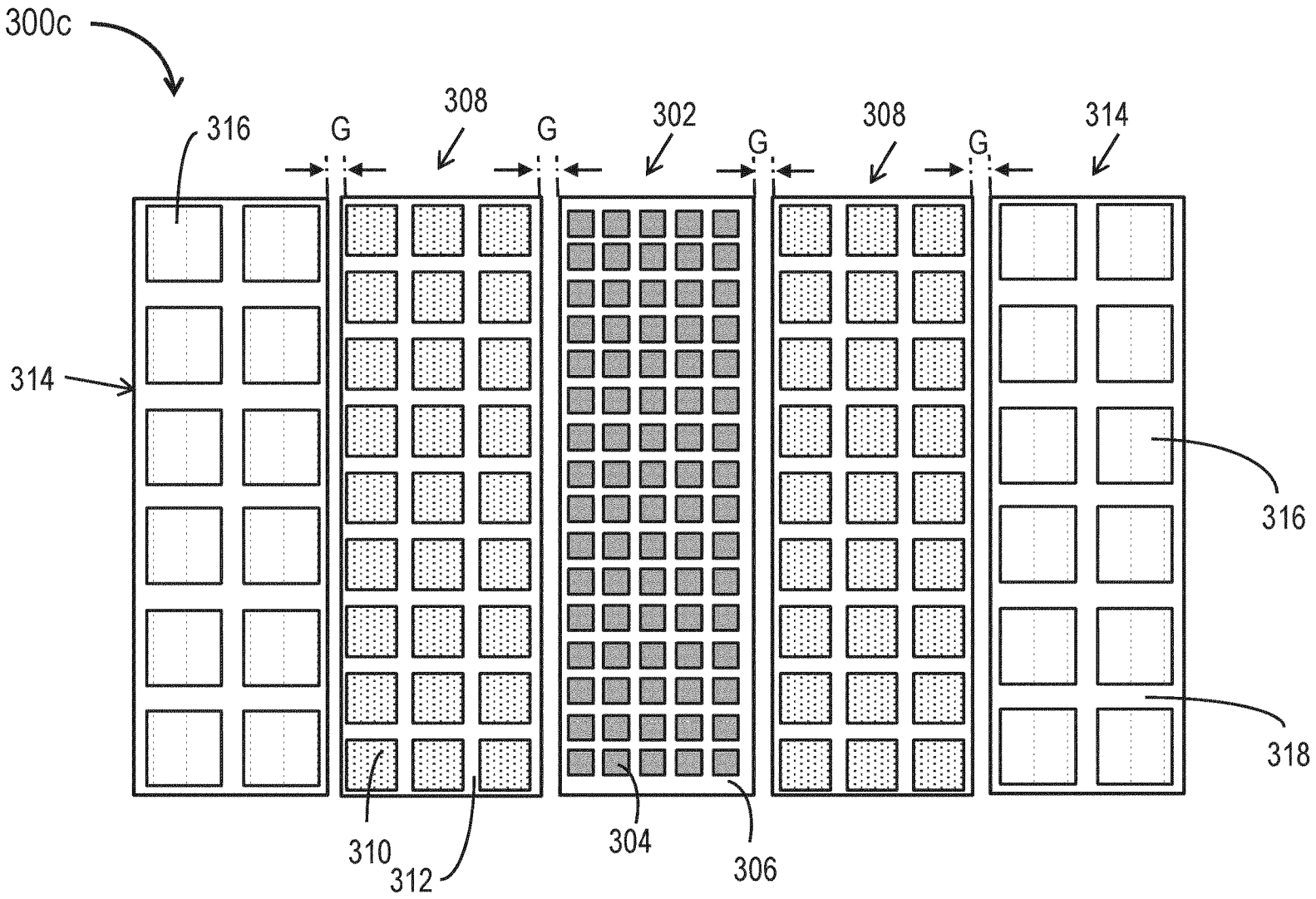

Referring to FIGS. 3A-C, block diagrams illustrating example embodiments of various tiling configurations of antenna subarrays within WSA antenna arrays 300*a-c* are shown, according to inventive concepts of this disclosure. Each of the WSA antenna arrays 300*a-c* can include a high frequency aperture region 302 including a plurality of antenna elements 304 arranged in first group of antenna subarrays 306, a mid-frequency aperture region 308 including a plurality of antenna elements 310 arranged in a second group of antenna subarrays 312, and a low frequency aperture region 314 including a plurality of antenna elements 316 arranged in a third group of antenna subarrays 318. The antenna subarrays 306, 308, and 312 can be arranged adjacent to one another along one dimension of each of the WSA antenna arrays 300*a-c*. The antenna elements 304, 310, and 316 can have sizes (or can be associated with lattice spacing) $S_1$, $S_2$, and $S_3$, respectively (as also discussed above with regard to FIG. 1 for antenna elements 102, 106, and 110). Each pair of adjacent antenna subarrays can be separated by a corresponding gap having a respective width G that satisfies the requirement $$G_{min} \le G \le \frac{S}{M} \text{ (or } G_{min} \le G \le h(S))$$

as discussed with regard to FIG. 1. In some implementations, the gaps may have different widths for distinct adjacent pairs of antenna subarrays.

In FIG. 3A, the high frequency aperture region 302 includes a single antenna subarray 306 arranged at one side of the WSA antenna array 300*a*. Assuming that only $S_3$ satisfies $$G_{min} \le \frac{S}{M} \text{ (or } G_{min} \le h(S))$$

but neither $S_1$ nor $S_2$ does, each pair of adjacent antenna subarrays has to include an antenna subarray 318 to allow for the gap separating that pair of adjacent antenna subarrays to satisfy the requirement $$G_{min} \le G \le \frac{S}{M} \text{ (or } G_{min} \le G \le h(S)).$$

Hence, each antenna subarray 306 is adjacent to an antenna subarray 318, and so is each antenna subarray 312.

In FIGS. 3B and 3C, both $S_2$ and $S_3$ are assumed to satisfy $$G_{min} \le \frac{S}{M} \text{ (or } G_{min} \le h(S))$$

but not $S_1$. As such, each pair of adjacent antenna subarrays has to include either an antenna subarray 312 or an antenna subarray 316 for the gap separating that pair of antenna subarrays to be able to satisfy $$G_{min} \le G \le \frac{S}{M} \text{ (or } G_{min} \le G \le h(S)).$$

In both WSA antenna arrays 300*b* and 300*c*, each pair of adjacent antenna subarrays includes at least one of an antenna subarray 312 and an antenna subarray 316. In the WSA antenna array 300*b*, the high frequency aperture region 302 includes a single antenna subarray 306 arranged at one side of the WSA antenna array 300*b*. However, in the WSA antenna array 300*c*, the high frequency aperture region 302 includes a single antenna subarray 306 arranged at the center of the WSA antenna array 300*c* between two antenna subarrays 312 of the mid-frequency aperture region 308. It is to be understood that other configurations (e.g., with regard to the number of aperture regions, the number of antenna subarrays of each aperture region, arrangements of antenna subarrays from distinct aperture regions relative to each other) are possible and are contemplated by the current disclosure.

Figure 4A:
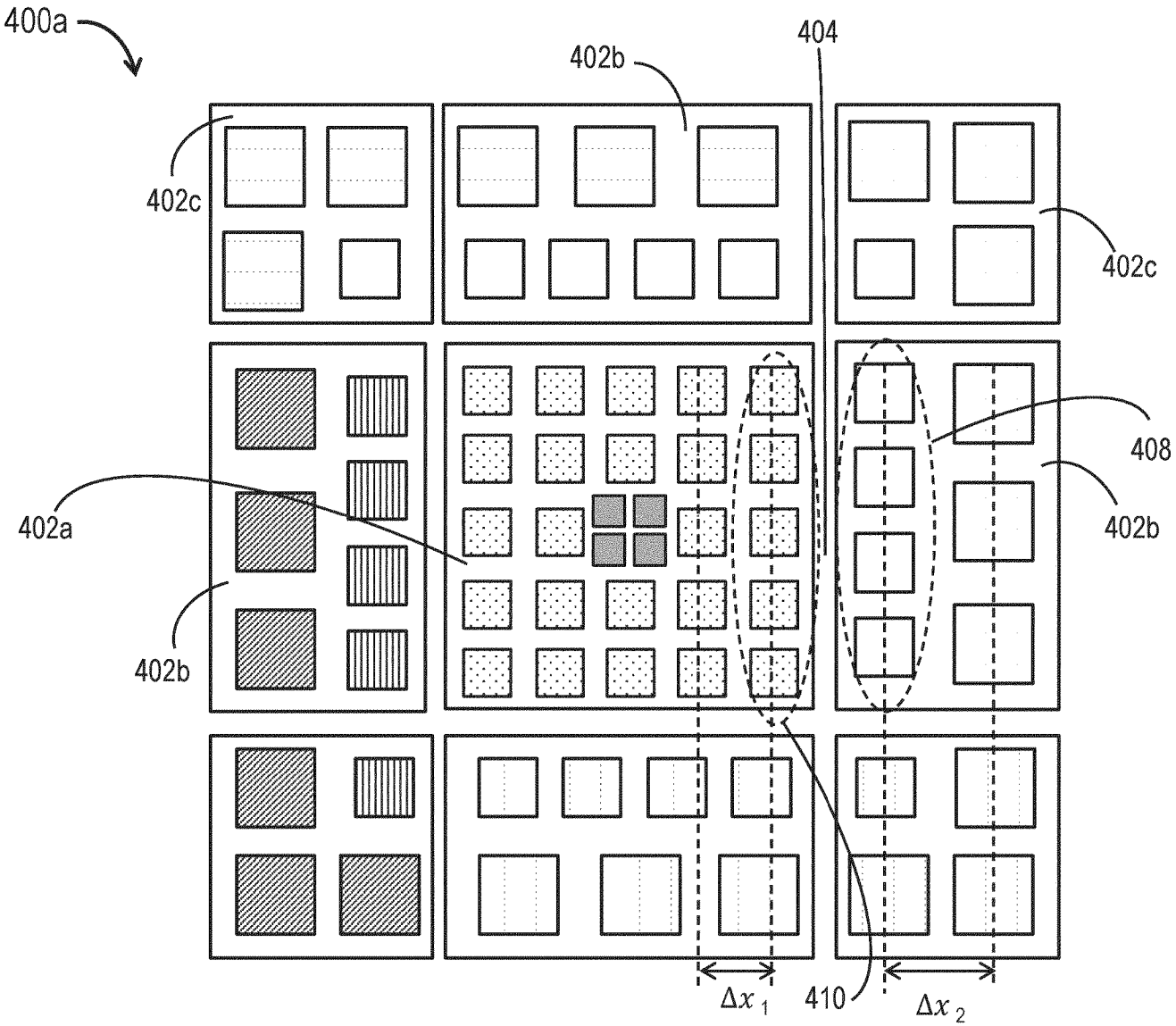
FIGS. 4A and 4B show block diagrams illustrating other example embodiments of tiling configurations of antenna subarrays within WSA antenna arrays, according to inventive concepts of this disclosure.
Figure 4B:
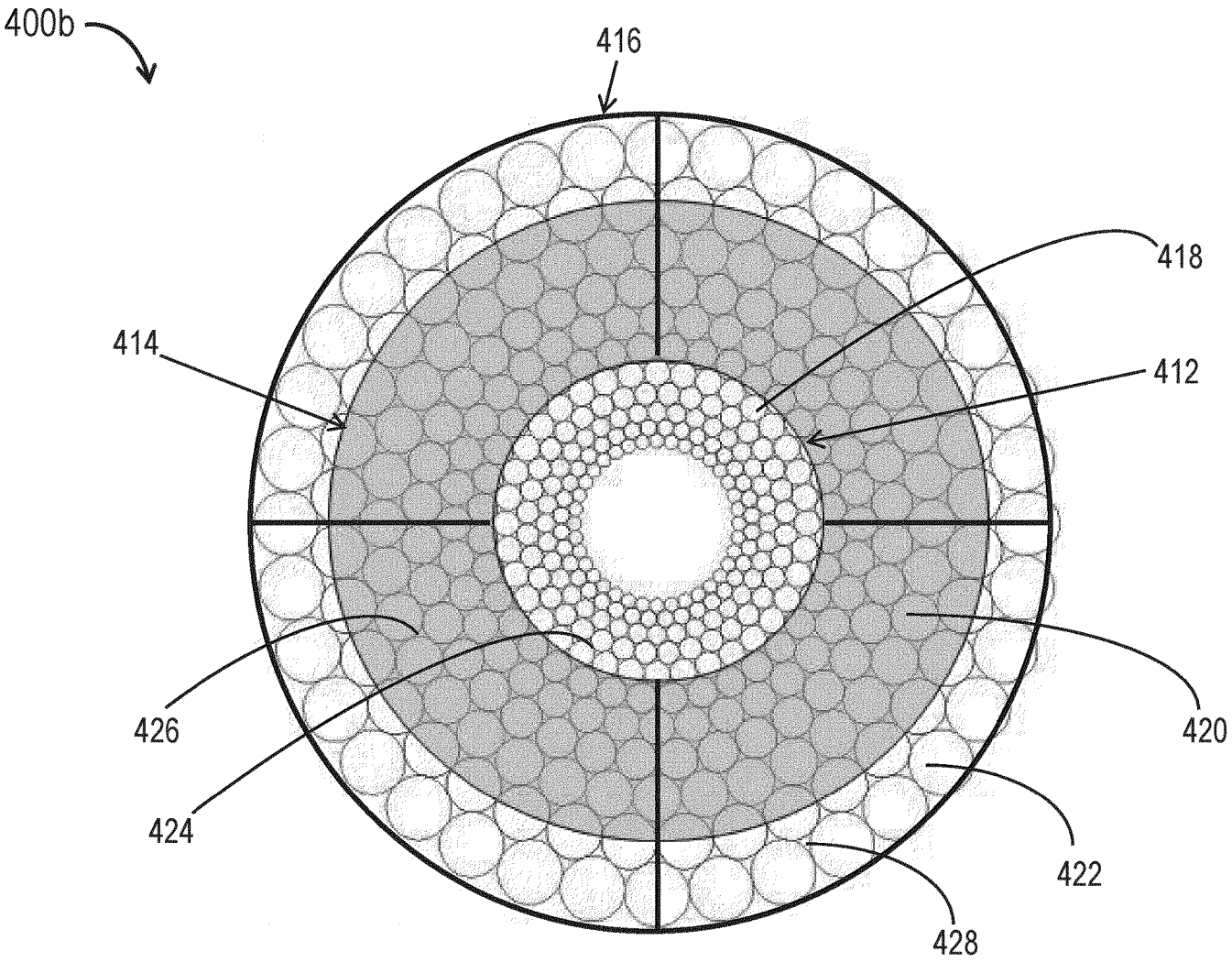

FIGS. 4A and 4B, show block diagrams illustrating other example embodiments of tiling configurations of antenna subarrays within WSA antenna arrays 400*a-b*, according to inventive concepts of this disclosure. The WSA antenna array 400*a* can include a plurality of distinct antenna subarrays 402*a-c*. Each of the antenna subarrays 402*a-c* can include a corresponding plurality of antenna elements associated with at least two antenna element sizes. For example, antenna subarray 402*a* can include a first set of antenna elements (e.g., at the center of the antenna subarray 402*a*) having a first size $X_1$ (or associated with a lattice spacing $d_1$), and a second set of antenna elements (e.g., arranged around the first set) having a second size $X_2$ greater than $X_1$ (or associated with a lattice spacing $d_2$ greater than $d_1$). Each antenna subarray 402*b* can include a third set of antenna elements having a third size $X_3$ (or associated with a lattice spacing $d_3$) and a fourth set of antenna elements having a size $X_4$ greater than $X_3$ (or associated with a lattice spacing $d_4$ greater than $d_3$). Also, antenna subarrays 402 can have antenna elements associated with sizes $X_3$ and $X_4$ (or associated with a lattice spacings $d_3$ and $d_4$). When the antenna subarrays 402*a-c* are assembled (or abutted) as depicted in FIG. 4A, the corresponding antenna elements can be arranged to form concentric aperture regions of similar antenna elements. Each concentric aperture region can be associated with a corresponding center frequency or a corresponding frequency subband. The size of antenna elements can increase towards the edges (or boundary) of the WSA antenna array 402*a*, and can decrease toward the center of the WSA antenna array 402*a*. In some other example configurations, some antenna subarrays may include antenna elements of different sizes while other antenna subarrays may include antenna elements of similar size.

For each pair of antenna subarrays, the width G of the corresponding gap separating that pair of antenna subarrays can satisfy $$G_{min} \le G \le \frac{S}{M} \text{ (or } G_{min} \le G \le h(S)),$$

where S represents the size of (or a lattice spacing associated with) each antenna element adjacent to the gap along at least one of two elongated boundaries of the gap. For example, for gap 404, each of the two sets of antenna elements 408 and 410 (around gap 404) represents antenna elements adjacent to gap 404 along one elongated boundary of that gap 404. At least one of the size of antenna elements 408 or the size of antenna elements 410 (or at least one of the lattice spacings $\Delta x_1$ or $\Delta x_2$) satisfies $$G_{min} \leq \frac{S}{M} \text{ (or } G_{min} \leq h(S))$$

to allow for gap 404 to satisfy $$G_{min} \leq G \leq \frac{S}{M} \text{ (or } G_{min} \leq G \leq h(S)).$$

In FIG. 4B, the WSA antenna array 400*b* can include a plurality of concentric aperture regions; a high frequency aperture region 412 including a plurality of relatively small-sized antenna elements 418, a mid-frequency aperture region 414 including a plurality of relatively mid-sized antenna elements 420, and a low frequency aperture region 416 including a plurality of relatively large-sized antenna elements 422. The high frequency aperture region 412 can have a ring shape and can include a single antenna subarray 424 having the same shape. The center circle of the WSA antenna array 400*b* can be a hole or more generally free of antenna elements. In some implementations, the high frequency aperture region 412 (and the antenna subarray 424) can have a circular shape (e.g., no hole in the middle). The mid-frequency aperture region 414 can form a ring, and can include multiple antenna subarrays 426 each occupying an angular sector of the ring defining the mid-frequency aperture region 414. In some implementations, the mid-frequency aperture region 414 include a single antenna subarray 426 having a ring shape. The low frequency aperture region 416 can form an outer ring of the WSA antenna array 400*b*, and can include multiple antenna subarrays 428 each occupying an angular sector of the ring defining the low frequency aperture region 416. In some implementations, the low frequency aperture region 416 include a single antenna subarray 428 having a ring shape.

The antenna elements within each antenna subarrays (or aperture region) can be uniformly sized or associated with at least two distinct sizes. Also, for each pair of adjacent antenna subarrays, the corresponding gap separating that pair of antenna subarrays can be designed (or defined) to satisfy the manufacturing and performance constraints discussed above with regard to FIGS. 1, 3A-C and 4A. As such, for each gap separating a pair of adjacent antenna subarrays, the antenna elements adjacent to the gap along at least one elongated boundary of the gap can have a size (or can be associated with a lattice spacing) satisfying $$G_{min} \leq \frac{S}{M} \text{ (or } G_{min} \leq h(S)).$$

It is to be appreciated that any WSA antenna array with any of the subarray tiling configurations described or contemplated by this disclosure can include any of the beamformer circuits described with respect to FIGS. 2A-2C or a combination thereof. Also, antenna elements described herein can include a Vivaldi antenna element, a Fuse antenna element, a differential BAVA antenna element, a spiral antenna element, a dipole antenna element, a bowtie antenna element, a planar sheet-based antenna element, or a combination thereof. Also, antenna subarrays described or contemplated by this disclosure can have (or form) a planar surface or a curved surface, for example, to conform with a curved platform structure such as a surface of an airplane. For example, the base surface (e.g., the PCB surface) of an antenna subarray can be curved forming an arc along at least one dimension of the antenna subarray. The antenna subarrays can be abutted (or tiled) using an adhesive material, mechanical components (e.g., hinges, clips, screws, etc.), or a combination thereof.

Figure 5:
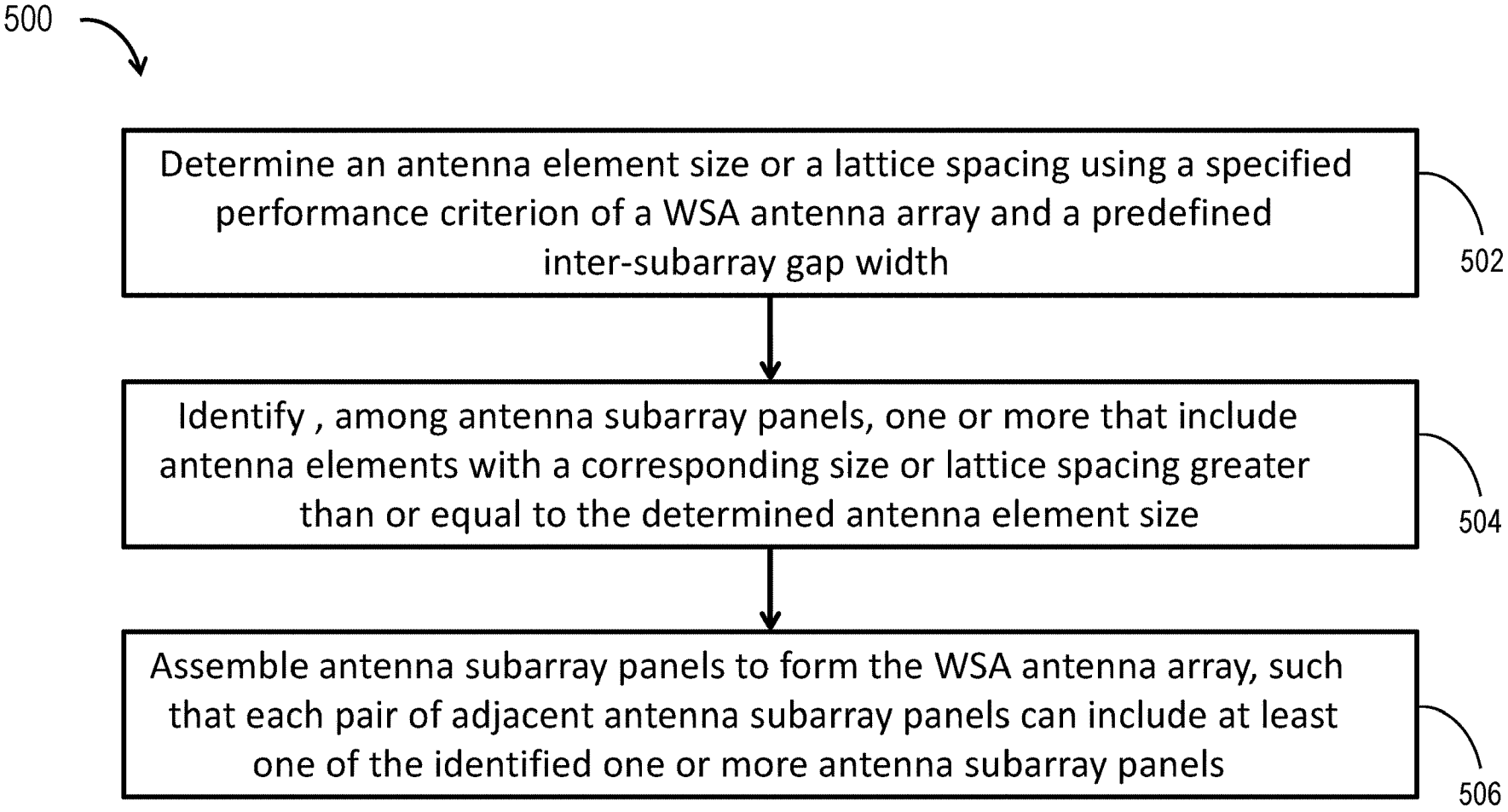
FIG. 5 shows a flowchart illustrating an example embodiment of a method of assembling a WSA antenna array, according to inventive concepts of this disclosure.

FIG. 5 shows a flowchart illustrating an example embodiment of a method 500 of assembling a WSA antenna array system, according to inventive concepts of this disclosure. The method 500 can include determining an antenna element size or a lattice spacing using a specified performance criterion of a WSA antenna array and a predefined inter-subarray gap width (step 502). The method 500 can include identifying, among multiple antenna subarray panels, one or more antenna subarray panels each including antenna elements at a boundary of that antenna subarray panel with a corresponding size greater than or equal to the determined antenna element size (step 504). The method 500 can include assembling the antenna subarray panels to form the WSA antenna array, such that each pair of adjacent antenna subarray panels can include at least one of the identified one or more antenna subarray panels (step 506).

The method 500 can include determining an antenna element size or a lattice spacing using a specified performance criterion of a WSA antenna array and a predefined inter-subarray gap width (step 502). The predefined inter-subarray gap width can include $G_{min}$ representing the minimum gap width that can be achieved (or implemented) when tiling or abutting a pair of antenna subarrays adjacent to one another, or another value defined based on $G_{min}$ (e.g., 1.1 $G_{min}$). The specified performance criterion can include a specified SLL relative to the main lobe of the WSA antenna array to be assembled (e.g., in dBs) or other specified antenna performance degradation metric. A processor or a human may use the constraint $$G_{min} \leq \frac{S}{M} \text{ (or } G_{min} \leq h(S))$$

discussed above to determine an antenna element size value (or a lattice spacing) S satisfying the above constraint. Determining the value S can include determining the value of M or the function h, for example, based on simulation results for various inter-subarray gap width values G and corresponding simulation antenna performance values (e.g., corresponding relative SLL values). The processor or human can determine the value S using the determined M value (or function h) and the $G_{min}$ value. For example, S can be defined as $M \times G_{min}$.

The method 500 can include a person (or a computer executing computer code instructions) identifying, among multiple available (or manufactured) antenna subarray panels, one or more antenna subarray panels each having antenna elements having a size or associated with a lattice spacing greater than or equal to the determined value S for at a boundary of that antenna subarray panel (step 504). Each antenna subarray panel of the multiple antenna subarray panels can include a corresponding plurality of antenna elements. The plurality of antenna elements of each antenna subarray panel can be sized to operate at one or more frequency subbands of multiple frequency subbands supported by the WSA antenna array to be assembled. At least two antenna elements of the multiple antenna subarray panels can be sized differently or can be associated with different lattice spacings. Identifying the one or more antenna subarray panels may include measuring (or determining) sizes of (or lattice spacings associated with) antenna elements arranged at the boundaries of corresponding antenna subarray panels. As discussed above with regard to FIG. 4A, the antenna elements arranged adjacent to at least one boundary of each identified antenna subarray panel (e.g., antenna elements 408 or 410 in FIG. 4A) would have a size (or would be associated with a lattice spacing) greater than or equal to the determined value S. The method 500 may further include designing and/or manufacturing the antenna subarray panels such that at least one or more of the manufactured panels have antenna elements arranged along at least one corresponding boundary sized to exceed the determined antenna element size.

The method 500 can include assembling the antenna subarray panels to form the WSA antenna array, such that each pair of adjacent antenna subarray panels can include at least one of the identified one or more antenna subarray panels (step 506). Assembling the antenna subarray panels can include abutting the panels on a platform structure (e.g., aircraft, vehicle, antenna base or support, etc.). When abutting the antenna subarray panels, antenna subarray panels can be abutted or tiled such that for each gap separating a pair of adjacent antenna subarray panels, antenna elements adjacent to that gap along either side of the gap have a size (or are associated with a lattice spacing) greater than the predetermined value S.

Assembling the plurality of antenna subarray panels can include setting, for each pair of adjacent subarray panels, a corresponding inter-subarray gap width between the predefined inter-subarray gap width and a tolerable gap width. The predefined inter-subarray gap width can include $G_{min}$ while the tolerable gap width can be equal to S/M (or h(S)). The method 500 can include determining the tolerable width S/M (or h(S)) using computer simulations. Specifically, assembling (or abutting) the plurality of antenna subarray panels can include setting a gap between each adjacent pair of antenna subarray panels with a width G that satisfies $$G_{min} \leq G \leq \frac{S}{M} \text{ (or } G_{min} \leq G \leq h(S)).$$

According to at least some example embodiments of the current disclosure, WSA antenna array systems described herein and assembling methods thereof allow for subarray-tiled WSA antenna arrays with mitigated periodic peak SLL (relative to the main lobe), reduced average SLL noise, and improved gain and beam width. Also, WSA antenna array systems described herein allow for relatively large WSA antenna arrays with increased sensitivity.

The construction and arrangement of the systems and methods are described herein as illustrative examples and are not to be construed as limiting. Although only a few embodiments have been described in detail in this disclosure, many modifications are possible (e.g., variations in sizes, dimensions, structures, shapes and proportions of the various elements, values of parameters, mounting arrangements, use of materials, colors, orientations). For example, the position of elements may be reversed or otherwise varied and the nature or number of discrete elements or positions may be altered or varied. Accordingly, all such modifications are intended to be included within the scope of the inventive concepts disclosed herein. The order or sequence of any operational flow or method of operations may be varied or re-sequenced according to alternative embodiments. Other substitutions, modifications, changes, and omissions may be made in the design, operating conditions and arrangement of the exemplary embodiments without departing from the broad scope of the inventive concepts disclosed herein.

What is claimed is:

1. An antenna array system comprising:

a plurality of antenna subarrays tiled together along a surface area to form a single wavelength scaled aperture (WSA) antenna array, each antenna subarray including a respective sub-array panel and a corresponding plurality of antenna elements that are mounted on the respective subarray panel and sized to support a corresponding frequency subband of a plurality of frequency subbands supported by the WSA antenna array, and at least two antenna elements of the plurality of antenna subarrays sized differently; and one or more beamformer circuits, each of the one or more beam former circuits communicatively coupled to at least one of the plurality of antenna subarrays, for each pair of adjacent antenna subarrays of the plurality of antenna subarrays, each antenna element, of one of the pair of adjacent antenna subarrays, adjacent to an inter-subarray gap separating the subarray panels of the pair of adjacent subarrays, is sized to be greater than or equal to a predetermined value, the predetermined value determined based on a predefined width of the inter-subarray gap, the inter-subarray gap arranged along the surface area.

2. The antenna array system of claim 1, wherein the plurality of antenna subarrays includes at least:

a first group of antenna subarrays with corresponding antenna elements having a first size and supporting a first frequency subband of the plurality of frequency subbands; and a second group of antenna subarrays with corresponding antenna elements having a second size different from the first size, and supporting a second frequency subband, of the plurality of frequency subbands, different from the first frequency subband.

3. The antenna array system of claim 2, wherein the plurality of antenna subarrays further includes:

a third group of antenna subarrays with corresponding antenna elements having a third size different from the first and second sizes, and supporting a third frequency subband, of the plurality of frequency subbands, different from the first and second frequency subbands.

4. The antenna array system of claim 2, wherein the antenna subarrays of the first group and the antenna subarrays of the second group are arranged according to corresponding concentric regions of the WSA array.

5. The antenna array system of claim 2, wherein at least one of the first and second sizes is greater than or equal to the predetermined value, and a first subarray of the first group of antenna subarrays is arranged adjacent to a second subarray of the second group of antenna subarrays.

6. The antenna array system of claim 4, wherein the antenna subarrays of the second group are arranged according to one or more corresponding concentric ring regions, and each subarray of the second group occupies an angular sector of one of the one or more concentric ring regions.

7. The antenna array system of claim 1, wherein the one or more beamformer circuits include:

for each antenna subarray, a corresponding plurality of partial analog beamformer circuits; and one or more hybrid digital beamformer circuits, each hybrid digital beamformer circuit having radio frequency channels that are configured to be simultaneously tuned to a single center frequency.

8. The antenna array system of claim 7 comprising a single hybrid digital beamformer circuit and further comprising:

a radio frequency (RF) switch communicatively coupled to the pluralities of partial analog beamformer circuits associated with the plurality of antenna subarrays and to the single hybrid digital beamformer circuit, the RF switch configured to alternately connect the single hybrid digital beamformer circuit to separate groups of the partial analog beamformer circuits associated with the plurality of antenna subarrays.

9. The antenna array system of claim 7 comprising:

at least one separate hybrid digital beamformer circuit for each group of antenna subarrays associated with a corresponding frequency subband, the at least one separate hybrid digital beamformer circuit connected to partial analog beamformer circuits associated with that group of antenna subarrays.

10. The antenna array system of claim 1, wherein one or more beamformer circuits include one or more direct digital beam former circuits, each direct digital beam former circuit having channels capable of operating simultaneously at distinct center frequencies.

11. The antenna array system of claim 1 comprising at least one antenna subarray having antenna elements of at least two different sizes.

12. The antenna array system of claim 11, wherein for each of the at least one antenna subarray, corresponding antenna elements having a larger size than other antenna elements in that antenna subarray are arranged adjacent to at least one outer boundary of the antenna subarray.

13. The antenna array system of claim 1, wherein the predefined width of the gap represents a minimum gap width that is implementable.

14. The antenna array system of claim 13, wherein the predetermined value is determined based on the minimum width of the gap separating the pair of adjacent antenna elements and a specified performance criterion of the WSA antenna array.

15. The antenna array system of claim 1, wherein at least one of the antenna subarrays is arranged to form a curved structure.

16. A method of assembling a wavelength scaled aperture (WSA) antenna array system, the method comprising:

determining an antenna element size using a specified performance criterion of a WSA antenna array and a predefined inter-subarray gap width;

identifying, among a plurality of antenna subarray panels, one or more antenna subarray panels each including antenna elements at a boundary of that antenna subarray panel with a corresponding size greater than or equal to the determined antenna element size, each antenna subarray panel of the plurality of antenna subarray panels including a corresponding plurality of antenna elements, and at least two antenna elements of the plurality of antenna subarray panels having different antenna element sizes; and assembling the plurality of antenna subarray panels along a surface area to form the WSA antenna array, such that each pair of adjacent antenna subarray panels (i) includes at least one of the identified one or more antenna subarray panels, and (ii) is separated by a respective inter-subarray gap arranged along the surface area and having a width defined based on the inter-subarray gap width.

17. The method of claim 16 further comprising manufacturing the plurality of antenna subarray panels.

18. The method of claim 16, wherein assembling the plurality of antenna subarray panels includes:

setting, for each pair of adjacent subarray panels, a corresponding inter-subarray gap width between the predefined inter-subarray gap width and a tolerable gap width.

19. The method of claim 18, further comprising:

determining the tolerable gap width using a size of antenna elements of one of the pair of adjacent subarray panels arranged adjacent to the gap.

20. An antenna array system comprising:

a plurality of antenna subarray panels assembled along a surface area to form a single wavelength scaled aperture (WSA) antenna array, each antenna subarray panel including a corresponding plurality of antenna elements such that at least two antenna elements of the plurality of antenna subarray panels have different antenna element sizes; and one or more beamformer circuits, each of the one or more beam former circuits communicatively coupled to at least one of the plurality of antenna subarray panels, for each adjacent pair of the plurality of antenna subarray panels, each antenna element, adjacent to an inter-subarray gap separating the adjacent pair of antenna subarray panels along an elongated boundary of the inter-subarray gap, is sized to be greater than a predetermined value, the predetermined value determined based on a predefined width of the inter-subarray gap separating the pair of adjacent antenna subarrays, the inter-subarray gap arranged along the surface area.

* * * * *